US012788091B2

(12) United States Patent
Teetzel et al.

(10) Patent No.: US 12,788,091 B2
(45) Date of Patent: Nov. 10, 2026

(54) MODULAR SIDE SHROUD ASSEMBLY AND HELMET SYSTEM EMPLOYING SAME

(71) Applicant: WILCOX INDUSTRIES CORP., Newington, NH (US)

(72) Inventors: James W. Teetzel, Portsmouth, NH (US); Elliott S. Turner, Newmarket, NH (US); Mathew A. Reichl, Portsmouth, NH (US)

(73) Assignee: Wilcox Industries Corp., Newington, NH (US)

( * ) Notice: Subject to any disclaimer, the term of this patent is extended or adjusted under 35 U.S.C. 154(b) by 41 days.

(21) Appl. No.: 18/641,340

(22) Filed: Apr. 20, 2024

(65) Prior Publication Data

US 2024/0349837 A1 Oct. 24, 2024

Related U.S. Application Data

(60) Provisional application No. 63/461,302, filed on Apr. 23, 2023.

(51) Int. Cl.
*A42B 3/04* (2006.01)

(52) U.S. Cl.
CPC ..... *A42B 3/044* (2013.01)

(58) Field of Classification Search
CPC ..... A42B 3/044; A42B 3/0406; A42B 3/042; A42B 3/30
See application file for complete search history.

(56) References Cited

U.S. PATENT DOCUMENTS

| | | | |
|---|---|---|---|
| 5,683,831 | A | 11/1997 | Baril et al. |
| 7,219,370 | B1 | 5/2007 | Teetzel et al. |
| 8,826,463 | B2 | 9/2014 | Teetzel et al. |
| 8,984,665 | B2 | 3/2015 | Celona et al. |
| 9,113,129 | B2 | 8/2015 | Teetzel et al. |
| 10,928,163 | B2 | 2/2021 | Zimmer |
| 11,452,328 | B2 | 9/2022 | Franzino et al. |

(Continued)

FOREIGN PATENT DOCUMENTS

| | | |
|---|---|---|
| AU | 2017398427 B2 | 8/2018 |
| CA | 2524510 A1 | 4/2007 |

(Continued)

OTHER PUBLICATIONS

Extended European Search Report in Application No. 24171529.1 dated Sep. 30, 2024, 6 pages.

(Continued)

*Primary Examiner* — Bao-Thieu L Nguyen
(74) *Attorney, Agent, or Firm* — McLane Middleton, Professional Association

(57) ABSTRACT

A modular side shroud assembly for a helmet mounting system associated with a helmet comprises a housing enclosing shroud circuitry, the housing configured to detachably couple to a side of the helmet. A proximal end of the housing is configured to couple to a rear battery interface of the helmet mounting system. A forward end of the housing has a receptacle configured to removably couple a plurality of modular and interchangeable accessory devices, wherein the receptacle includes an electrical connector for electrically coupling the plurality of modular and interchangeable accessory devices to the shroud circuitry.

18 Claims, 18 Drawing Sheets

(56) References Cited

U.S. PATENT DOCUMENTS

| | | | | |
|---|---|---|---|---|
| 11,758,962 | B2 | 9/2023 | Havola | |
| 12,285,069 | B2 * | 4/2025 | Teetzel | A42B 3/0406 |
| 12,342,894 | B2 * | 7/2025 | Teetzel | A42B 3/04 |
| 2005/0174753 | A1 | 8/2005 | Cao et al. | |
| 2008/0170838 | A1 * | 7/2008 | Teetzel | A42B 3/042 348/E5.025 |
| 2008/0263752 | A1 * | 10/2008 | Solinsky | A42B 3/042 2/422 |
| 2009/0077721 | A1 | 3/2009 | Prendergast | |
| 2010/0031552 | A1 | 2/2010 | Houde-Walter | |
| 2011/0170280 | A1 * | 7/2011 | Soto | A42B 3/044 362/105 |
| 2012/0224356 | A1 * | 9/2012 | Fischer | A42B 3/044 362/106 |
| 2014/0000013 | A1 * | 1/2014 | Redpath | H05K 1/028 29/592.1 |
| 2014/0020159 | A1 * | 1/2014 | Teetzel | A42B 3/04 2/422 |
| 2014/0270800 | A1 | 9/2014 | Masarik | |
| 2015/0089726 | A1 * | 4/2015 | Long | A42B 3/0406 2/422 |
| 2015/0264229 | A1 * | 9/2015 | Teetzel | H04N 23/56 348/376 |
| 2016/0088891 | A1 * | 3/2016 | Walsh | A42B 3/003 2/421 |
| 2017/0205202 | A1 | 7/2017 | Teetzel et al. | |
| 2018/0360152 | A1 * | 12/2018 | Chang | A45F 5/02 |
| 2019/0101359 | A1 * | 4/2019 | Zimmer | A42B 3/306 |
| 2019/0104797 | A1 | 4/2019 | Teetzel et al. | |
| 2019/0208854 | A1 | 7/2019 | Teetzel et al. | |
| 2019/0386412 | A1 | 12/2019 | Goupil et al. | |
| 2020/0077732 | A1 | 3/2020 | O'Connell | |
| 2020/0225488 | A1 | 7/2020 | Goupil et al. | |
| 2020/0329806 | A1 | 10/2020 | Wong | |
| 2021/0315314 | A1 | 10/2021 | Teetzel et al. | |
| 2022/0071336 | A1 * | 3/2022 | Franzino | A42B 3/0433 |
| 2022/0408869 | A1 | 12/2022 | Franzino et al. | |
| 2023/0046229 | A1 * | 2/2023 | Moore | H02J 7/0013 |
| 2024/0000179 | A1 * | 1/2024 | Donato | A42B 3/042 |
| 2024/0035779 | A1 | 2/2024 | Teetzel et al. | |
| 2024/0080647 | A1 | 3/2024 | Musa et al. | |
| 2024/0164464 | A1 | 5/2024 | Teetzel et al. | |
| 2024/0204328 | A1 | 6/2024 | Teetzel et al. | |
| 2024/0255257 | A1 | 8/2024 | Teetzel et al. | |
| 2024/0298721 | A1 * | 9/2024 | Mitchell | H01M 50/178 |
| 2024/0315372 | A1 * | 9/2024 | Teetzel | A42B 3/04 |
| 2024/0356143 | A1 | 10/2024 | Teetzel et al. | |
| 2024/0377872 | A1 | 11/2024 | Teetzel et al. | |
| 2025/0009063 | A1 | 1/2025 | Teetzel et al. | |
| 2025/0234123 | A1 | 7/2025 | Teetzel et al. | |

FOREIGN PATENT DOCUMENTS

| | | | |
|---|---|---|---|
| CN | 201468108 | U | 5/2010 |
| WO | 2020237189 | A1 | 11/2020 |
| WO | 2022115531 | A1 | 6/2022 |

OTHER PUBLICATIONS

English machine translation of CN 201468108, publication date May 19, 2010 to Haixiong Yang.

* cited by examiner

MODULAR SIDE SHROUD ASSEMBLY AND HELMET SYSTEM EMPLOYING SAME

CROSS-REFERENCE TO RELATED APPLICATION

This application claims the priority benefit of U.S. provisional application No. 63/461,302 filed Apr. 23, 2023. The aforementioned application is incorporated herein by reference in its entirety.

BACKGROUND

The present invention relates to helmet mounting systems and, in particular, to a modular side shroud assembly and helmet mounting system employing same wherein the side shroud assembly is configured removably couple a plurality of modular and interchangeable accessory devices. In embodiments, the accessory devices are modular and interchangeable for a plurality of utilities, a plurality of designs, or both.

SUMMARY

A modular side shroud assembly for a helmet system and a helmet system employing same are provided. The helmet system supplies power, manages data, and controls helmet and helmet accessory functions. In embodiments, a cable cover/strap extends between a front shroud and a rear battery mounting bracket for routing power, data, and control signals to attached devices. In certain embodiments, an identification friend of foe (IFF) marking strobe or beacon is secured beneath the cable cover/strap along the centerline of the helmet. A hot shoe adapter is attachable to the rear battery mounting bracket to provide a bridge for coupling left and right side shrouds to the power, data, and control signals circuitry. The components can be attached to the helmet using attachment holes located on the helmet. In embodiments, the system is designed to accommodate different sized helmets.

In one aspect, a modular side shroud assembly for a helmet mounting system associated with a helmet, the helmet being of a type having a front, a rear, a rounded top, and left and right sides, includes a housing enclosing shroud circuitry, the housing configured to detachably couple to a side of the helmet. A proximal end of the housing is configured to couple to a rear battery interface of the helmet mounting system and a forward end of the housing has a receptacle configured to removably couple a plurality of modular and interchangeable accessory devices, wherein the receptacle includes an electrical connector for electrically coupling the plurality of modular and interchangeable accessory devices to the shroud circuitry.

In a more limited aspect, the modular side shroud assembly is in combination with the plurality of modular and interchangeable accessory devices, wherein the plurality of modular and interchangeable accessory devices are modular and interchangeable for a plurality of utilities, a plurality of designs, or both.

In another more limited aspect, the plurality of accessory devices are selected from the group consisting of headlamps, cameras, cable adapters, visible light headlamps, infrared headlamps, multi-color headlamps, off-band headlamps, and any combination thereof.

In another more limited aspect, the electrical connector is a USB type-C socket.

In another more limited aspect, the receptacle includes a threaded retention hole configured to receive a threaded fastener on one of accessory devices when the one of the accessory devices is coupled to the receptacle.

In another more limited aspect, the threaded fastener is captured on a housing of the accessory device.

In another more limited aspect, the receptacle includes a sealing surface disposed thereon and configured to inhibit intrusion of moisture.

In another more limited aspect, the shroud circuitry comprises a powered interface circuit board and a flex circuit comprising circuit components on a flexible substrate extending between the powered interface circuit board and at least one side shroud electrical contact.

In another more limited aspect, the modular side shroud assembly further comprises a powered rail and data interface portion comprising at least one attachment position configured for removable attachment and powering of a rail mountable accessory device.

In another more limited aspect, the helmet mounting system comprises first and second modular side shroud assemblies herein.

In another more limited aspect, the helmet mounting system further comprises one or both of a controller module and a video camera recording module in electrical communication with the housing circuitry.

In another more limited aspect, the plurality of modular and interchangeable accessory devices includes a camera, the helmet mounting system further including a wireless communication interface configured to transmit video information over a wireless network.

In another more limited aspect, the plurality of modular and interchangeable accessory devices includes a camera selected from the group consisting of a visible light camera, a low lux camera, a thermal camera, and an infrared camera.

In another more limited aspect, the helmet mounting system further includes a rear bridge link assembly attachable to the helmet intermediate the first and second modular side shroud assemblies, the rear bridge link assembly configured to electrically couple the shroud circuitry of the first modular side shroud assembly and the second modular side shroud assembly.

In another more limited aspect, the helmet mounting system further comprising a front shroud assembly configured to be attached to a front of the helmet and a strap extending between the front shroud assembly and the rear bridge link assembly, the strap housing a plurality of electrical conductors for electrically coupling the front shroud assembly to the rear bridge link assembly.

In another more limited aspect, the helmet mounting system further comprises an identification friend or foe (IFF) module.

In another more limited aspect, the proximal end of each of the first and second side shroud assemblies comprises a lip and the rear bridge link assembly comprises a side flange that engages with each of the lips to form a mechanical coupling between each of the first and second side shroud assemblies and the rear bridge link assembly.

In another more limited aspect, the rear bridge link assembly includes at least one battery interface for detachable coupling to a battery pack.

In another more limited aspect, the rear bridge link assembly is operable to transmit one or both of data and control signals between the first and second modular side shroud assemblies.

Certain advantages and benefits of the present development will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

FIG. 15 is a rear view of the helmet system and rear attachments appearing in

FIG. 14.

DETAILED DESCRIPTION OF THE PREFERRED EMBODIMENT(S)

Figure 1:
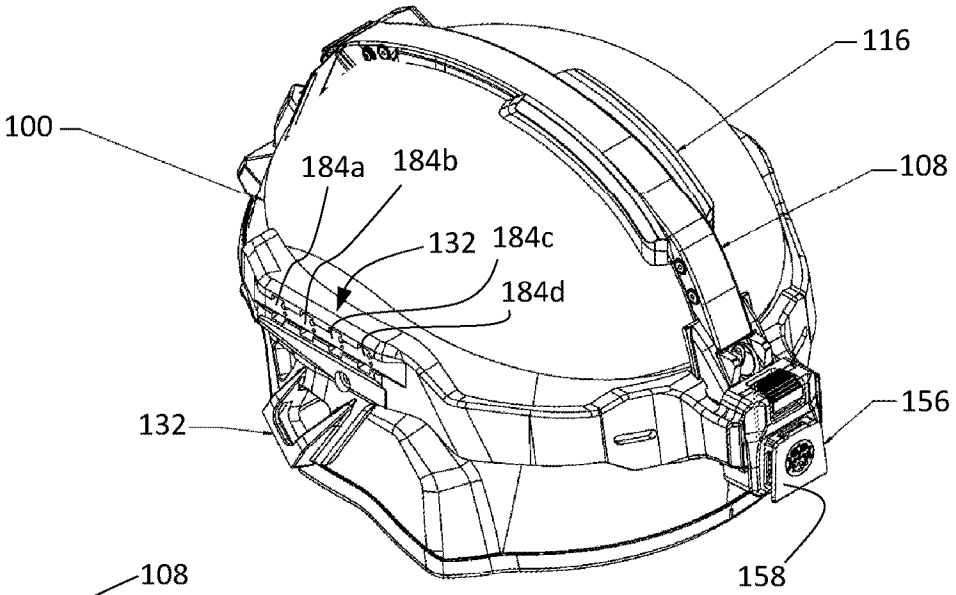
FIG. 1 is an isometric view of a helmet system in accordance with an exemplary embodiment of the invention, taken generally from above, the rear, and the left side.
Figure 3:
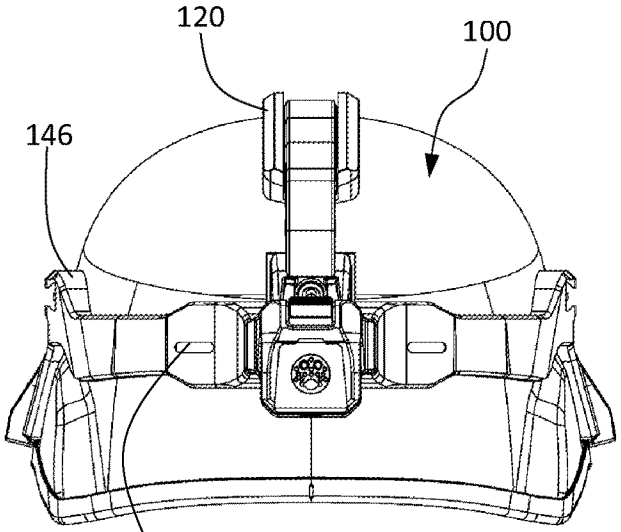
FIG. 3 is a rear view of the helmet system in FIG. 1.
Figure 2:
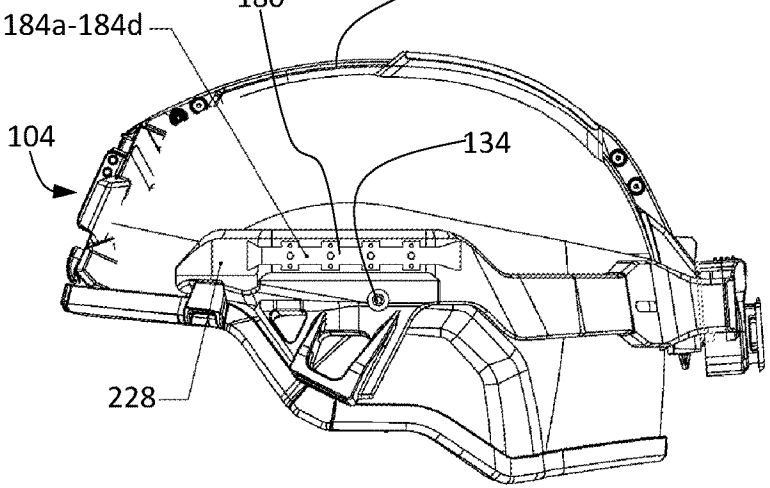
FIG. 2 is a left side view of the helmet system appearing in FIG. 1.
Figure 4:
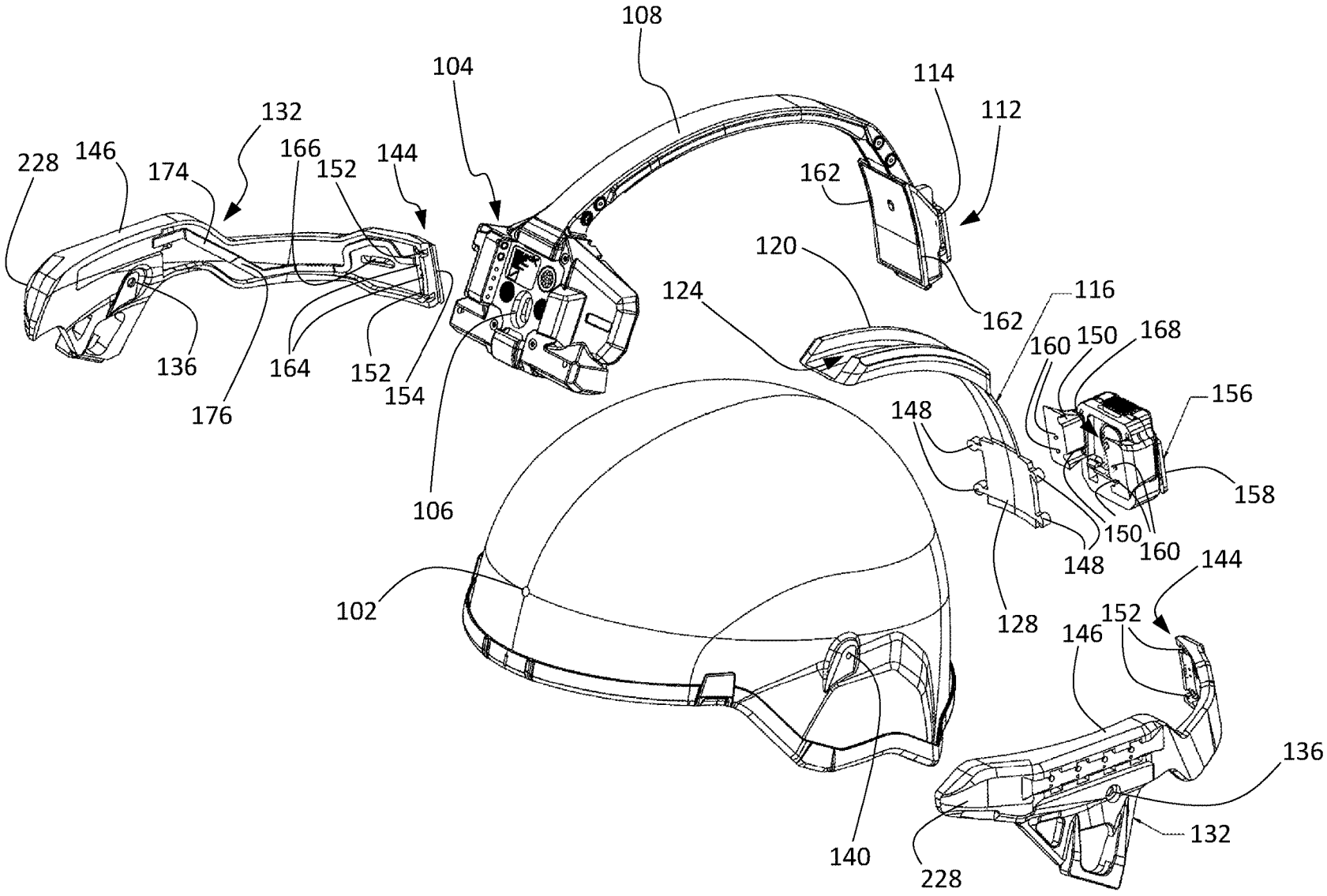
FIG. 4 is an exploded isometric view of the helmet system appearing in FIG. 1.

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention, and are not intended to limit the structure thereof to any particular position or orientation.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

Referring now to FIGS. 1-4, there appears a military combat helmet 100 having an exemplary helmet mounting assembly attached thereto. While the illustrated embodiment is configured for use with an Integrated Head Protection System (IHPS) helmet, it will be recognized that the present development could be adapted for use with all manner of protective helmets, including the Modular Integrated Communications Helmet (MICH), Advanced Combat Helmet (ACH), Enhanced Combat Helmet (ECH), and so forth.

A front shroud 104 is attached to the front of the helmet 100. The front shroud 104 is configured to removably attach a helmet accessory mount (not shown) for attaching viewing device (not shown), such as a night vision device or other optical or electro-optical device, camera, display, or the like. In certain embodiments, the front shroud 104 is configured for releasably attaching a mount available from Wilcox Industries Corp. of Newington, NH, such as the Wilcox G24 Mount, L4 G24 Mount, among others. A threaded fastener (not shown) passes through a front shroud clearance opening 106 in the front shroud 104 and threadably engages a tapped screw hole 102 in the front of the helmet 100.

A strap or cable cover 108 extends along a centerline of the helmet 100 from the front shroud 104 to a rear battery mounting bracket 112 disposed at the rear of the helmet 100. The battery mounting bracket 112 includes a hot shoe style interface 114. The front shroud 104, strap or cable cover 108, and battery bracket 112 may be as described in commonly-owned U.S. Pat. No. 10,886,646 or commonly-owned U.S. Pat. No. 11,360,309, each of which is incorporated herein by reference in its entirety.

An identification friend or foe (IFF) module 116 includes a plurality of light emitters which output an IFF marking strobe or beacon, which may be infrared (IR), visible, ultraviolet (UV), or a combination thereof. The emitters are housed in a housing 120 having a groove or channel 124. The groove or channel 124 receives the strap or cable cover 108, which secures the IFF module 116 in position on the helmet 100. The IFF module 116 further includes an electrical connector portion 128 which is disposed intermediate the helmet 100 and the battery mounting bracket 112. The electrical connector portion 128 provides an electrical connection between a power supply attached to the battery mount bracket 112 and IFF module 116. The configuration of the IFF housing 120 provides a very low profile on the helmet and reduces the potential for snagging. In embodiments, operation of the IFF module 116 is controlled by an attached controller such as the central network controller 208 (see FIGS. 18 and 19).

In embodiments, the IFF module 116 includes an optical receiver for sensing a laser signal to query the IFF module to determine whether the wearer is a friend or foe.

Left and right shrouds 132 are attached to the respective left and right sides of the helmet 100 via a threaded fastener 134 engaging a side shroud clearance opening 136 in the shrouds 132 and engaging a threaded opening 140 in the helmet 100, as well as threaded fasteners 170 (see FIG. 9) which pass through proximal clearance openings 166 near a proximal end 144 of the side shrouds 132 engaging an aligned tapped opening at the rear of the helmet 100. The proximal end 144 of the side shrouds 132 engages the electrical connector 128 as will be discussed in greater detail below. A mechanical coupling is provided via tabs 148 on the connector 128 which engage complementary channels 150 in the base of the hot shoe adapter 156.

A hot shoe adapter 156 includes a first set of hot shoe adapter electrical contacts 160 which engage aligned side shroud electrical contacts 164 on the side shrouds 132 to provide an electrical coupling with the side shrouds 132 via side shroud circuitry 174 within the shroud housing 146. The hot shoe adapter provides a bridge to connect the left and right side shrouds 132. The hot shoe adapter 156 further includes a second set of hot shoe adapter electrical contacts 168 which engage aligned battery mounting bracket electrical contacts on the battery mount bracket 112 to provide an electrical coupling between the rear battery mount 112 and the front shroud 104 via circuitry within the strap/cable cover 108.

Figure 5:
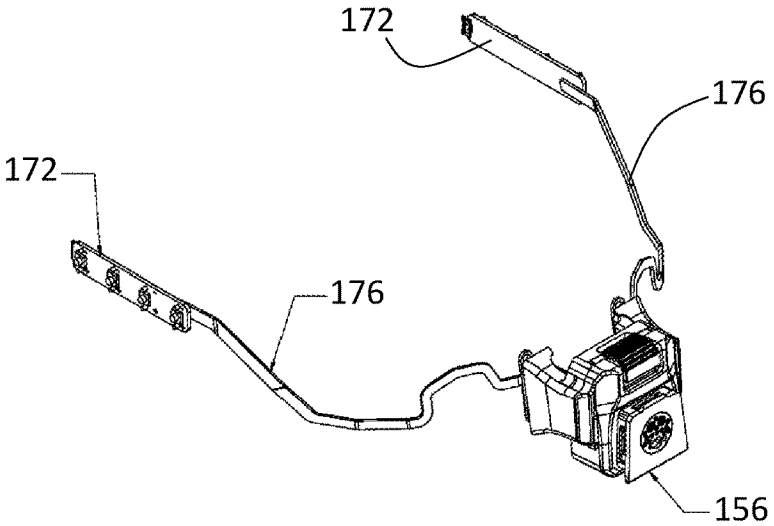
FIG. 5 is an isometric view illustrating the electrical connection between the hot shoe adapter and the power interface boards.
Figure 6:
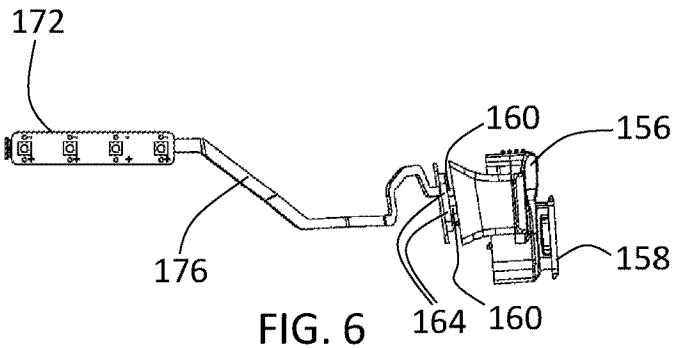
FIG. 6 is a side view of the electrical system appearing in FIG. 5.
Figure 7:
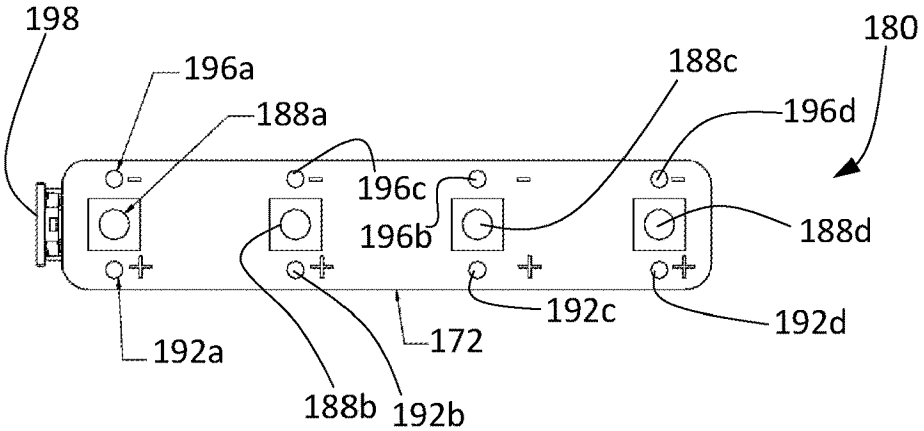
FIG. 7 is an enlarged plan view of the electrical interface board.

Referring now to FIGS. 5-7 and with continued reference to FIGS. 1-4, the side shroud circuitry 174 of each side shroud 132 includes a powered interface circuit board 172. Power to the powered interface board is provided via the hot shoe adapter 156 and the contacts 160 and 164. A flex circuit 176 comprising circuit components on a flexible film substrate extends within the housing 146 between the contacts 164 and the powered interface circuit board 172.

The side shroud includes a powered rail and data interface portion 180 which has multiple attachment positions (four in the illustrated embodiment) 184*a*, 184*b*, 184*c*, and 184*d*. In embodiments, the powered rail and data interface 180 is a sliding dovetail interface for sliding an accessory device to a desired one of the attachment positions. Each attachment position 184*a*-184*d* includes an aligned push button switch 188*a*-188*d* in electrical communication with respective positive contact pads 192*a*-192*d* and negative contact pads 196*a*-196*d*. The push button switches 188*a*-188*d* are normally open, momentary contact switches. When a powered accessory device is coupled to a given attachment position, the accessory device depresses the associated push button switch to close the circuit between the respective positive and negative contact pads. In this manner, the power interface board 172 distributes power only to the contact pads in use. An electrical connector 198 is disposed at a rearward end of the interface board 172 for distributing power to an LED headlamp module as described below. It will be recognized that the electrical switch and contact configurations illustrated herein are exemplary and illustrative only and configurations having additional or fewer combinations of push button switches and positive and negative contact pads are also contemplated.

Figure 8:
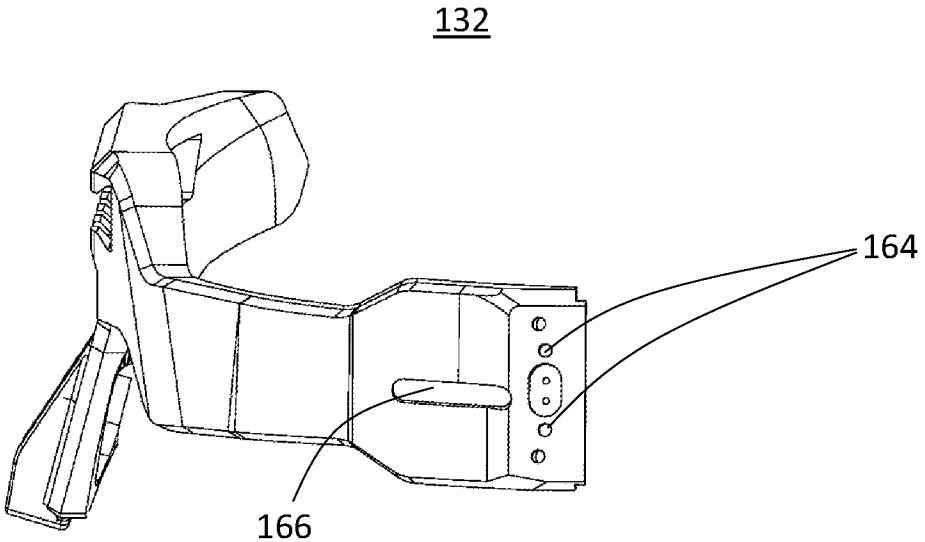
FIG. 8 is an isometric view of a side shroud illustrating the electrical contacts on the proximal end.

Referring now to FIG. 8 and with continued reference to FIGS. 1-7, there appears a left side shroud 132, illustrating the proximal end 144 and the electrical contacts 164 which engage aligned contacts 160 (see FIG. 10) on the hot shoe adapter 156.

Figure 9:
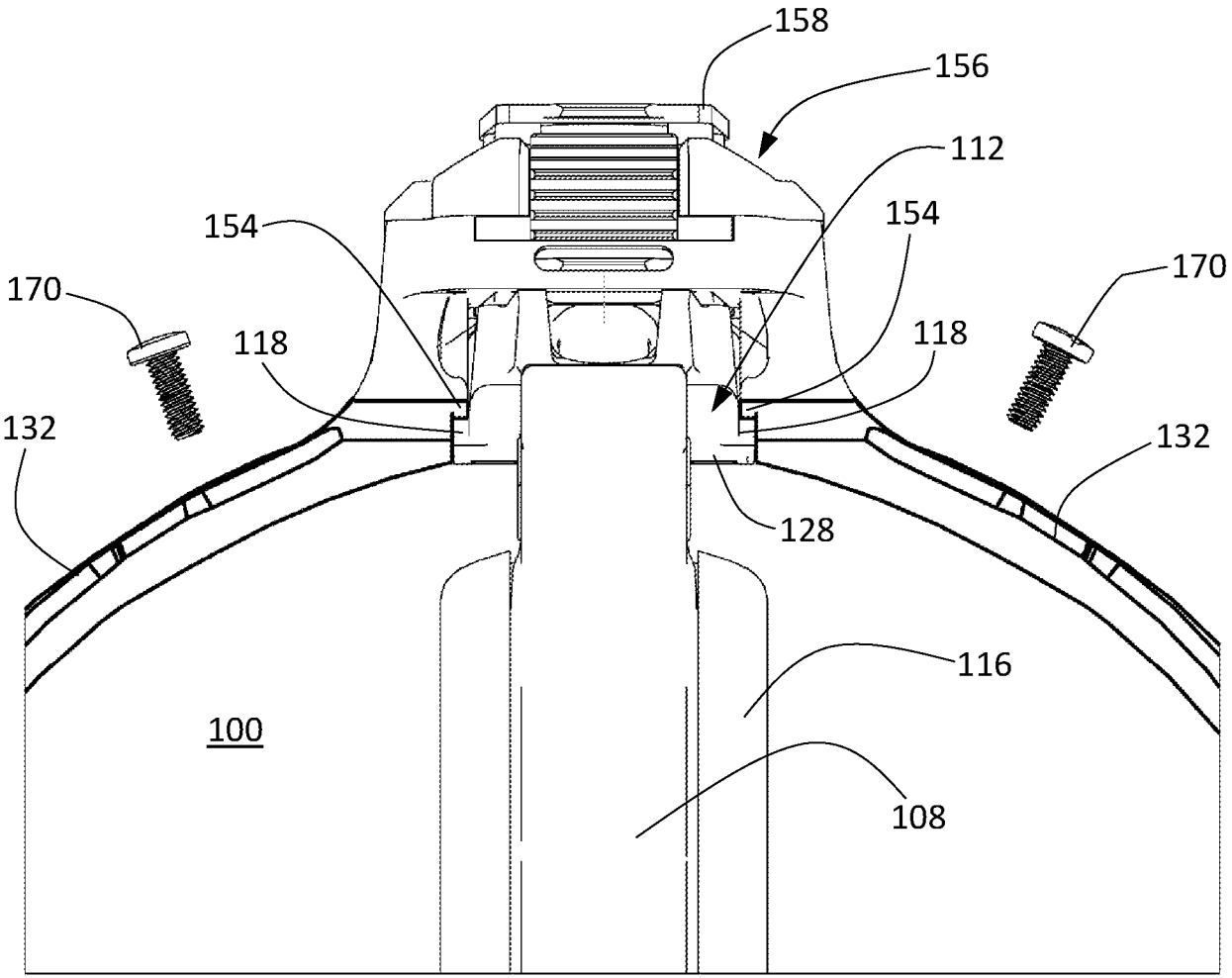
FIG. 9 is a fragmentary top view illustrating the connections between the rear battery bracket, side shrouds, and the hot shoe adapter.
Figure 10:
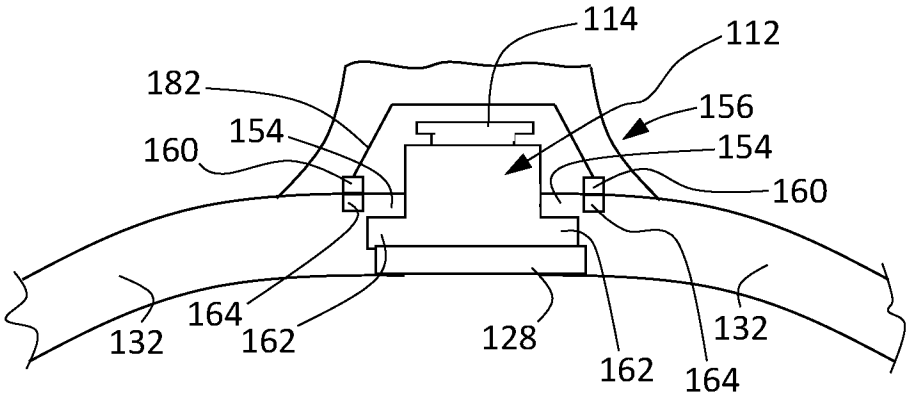
FIG. 10 is a highly schematic view illustrating the connections between the rear battery bracket, side shrouds, and the hot shoe adapter providing a bridge between the left and right side shrouds.

Referring now to FIGS. 9 and 10, and with continued reference to FIGS. 1-8, the proximal end 144 of each side shroud 132 includes a lip 154 which engages a complementary lip or side flange 118 on the battery mount bracket 112 to create a mechanical coupling therebetween. A plurality of contacts 164 engage aligned contacts 160 on the hot shoe adapter 156. Hot shoe adapter circuitry 182 within the hot shoe adapter 156 provides a bridge operable to couple the left and rights side shrouds 132 to the system. A threaded fastener 170 passes through a clearance opening 166 in each side shroud 132 and threadably engages a tapped opening (not shown) in the rear of the helmet 100.

Figure 11:
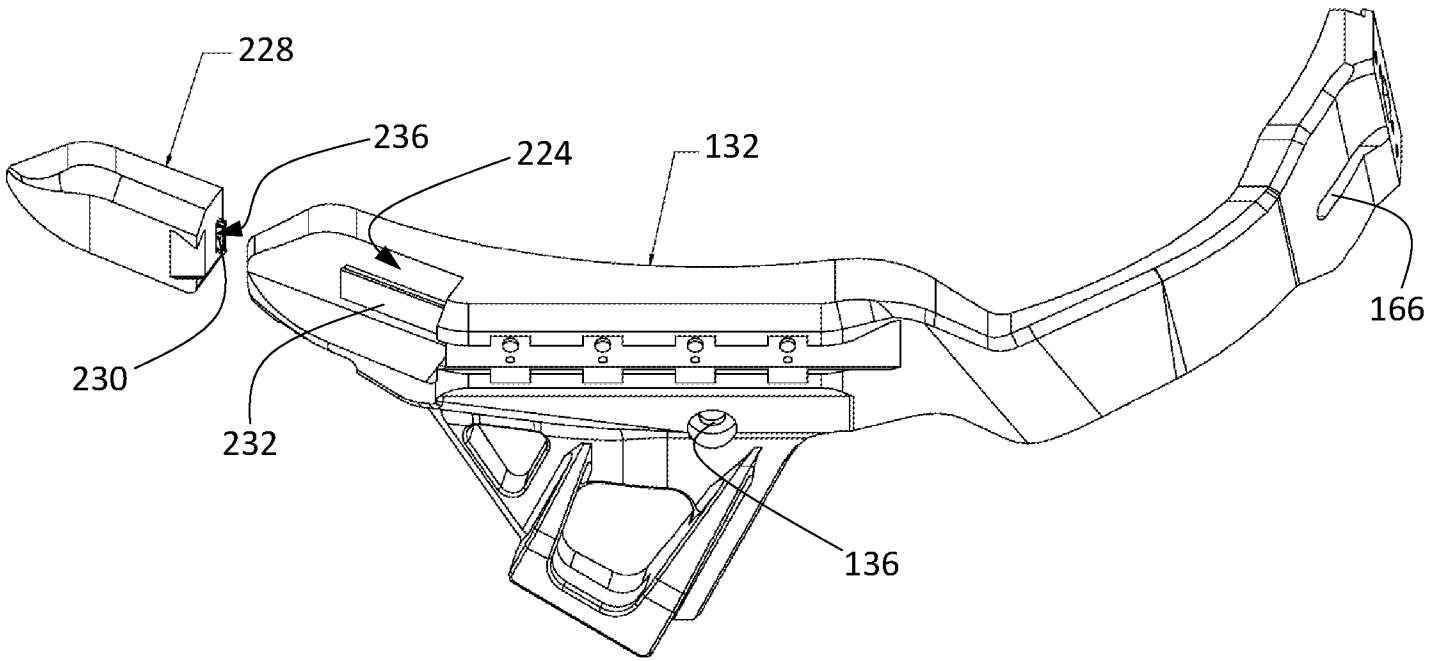
FIG. 11 is an enlarged view of a side shroud with swappable flashlight module.

Referring now to FIG. 11, and with continued reference to FIGS. 1-10, there is illustrated an enlarged side view of the left side shroud 132. The side shroud housing 146 includes a recess or socket 224 removably receiving a modular flashlight 228. The recess 224 includes a rail fastener 232 (e.g., having a T-shaped cross-section or dovetail shaped cross-section), which is slidably received within a complementary elongate channel 236 in the flashlight module 228. The module 228 includes flashlight module electrical contacts 230 which engage aligned contacts or pins on the shroud 132 to electrically couple the LED module 228 to the power interface board 172 when it fully seated in the recess 224.

Figure 19:
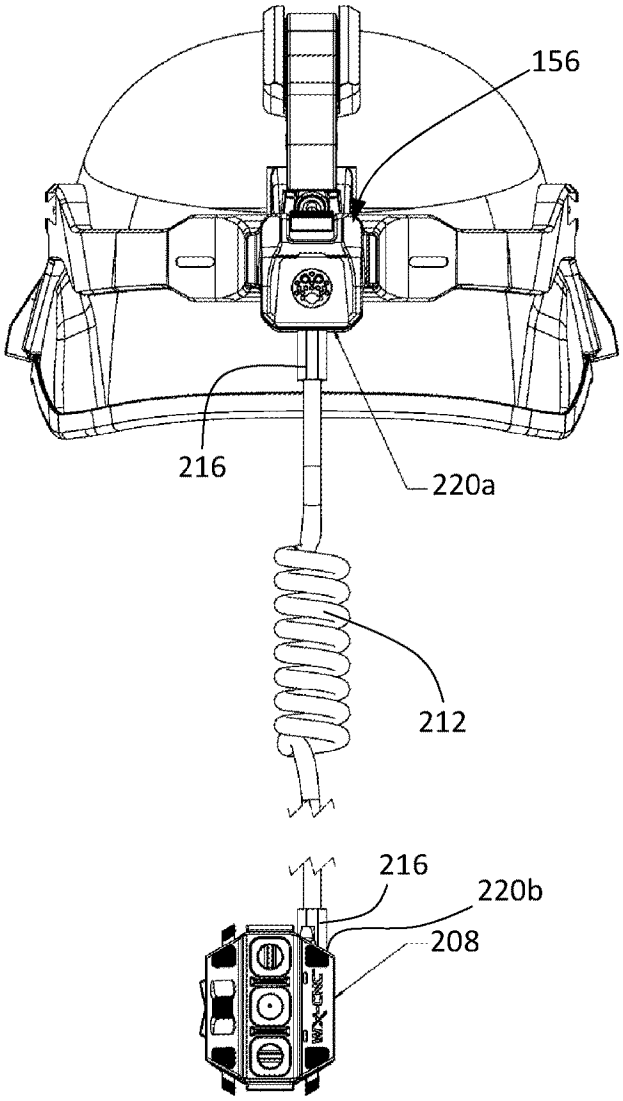
FIG. 19 is a rear view of the helmet system as shown in FIG. 18 with the Wilcox battery pack removed.
Figure 18:
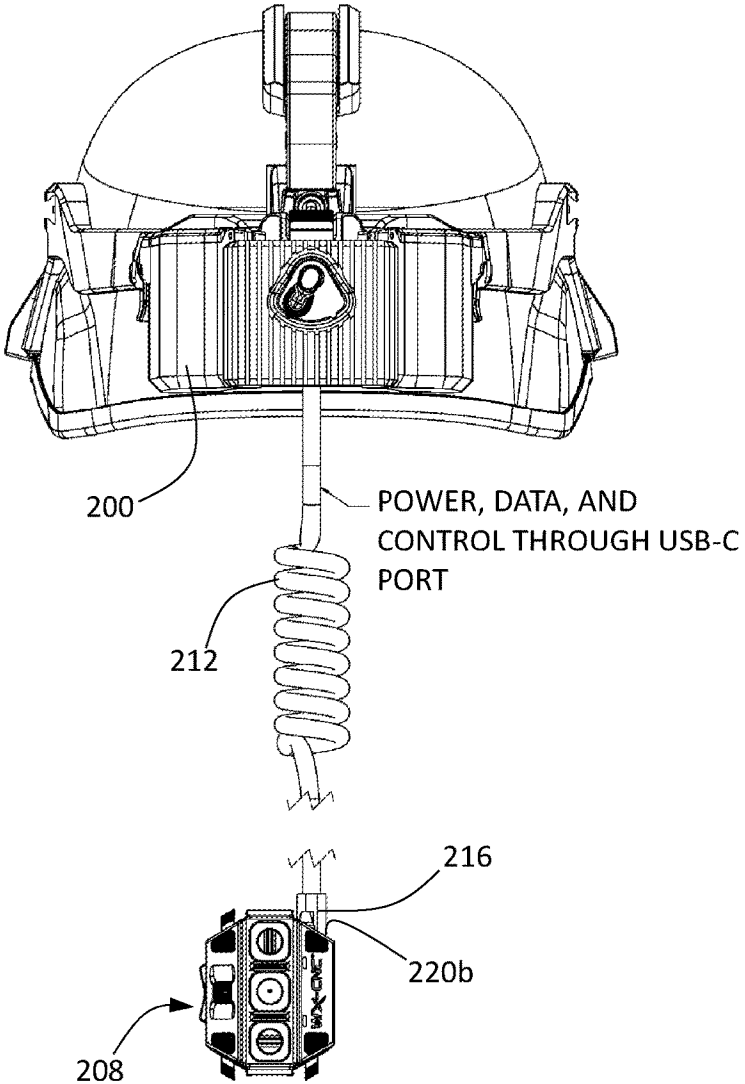
FIG. 18 is a rear view of the helmet system as shown in FIGS. 12 and 13 with an attached central network controller.
Figure 20:
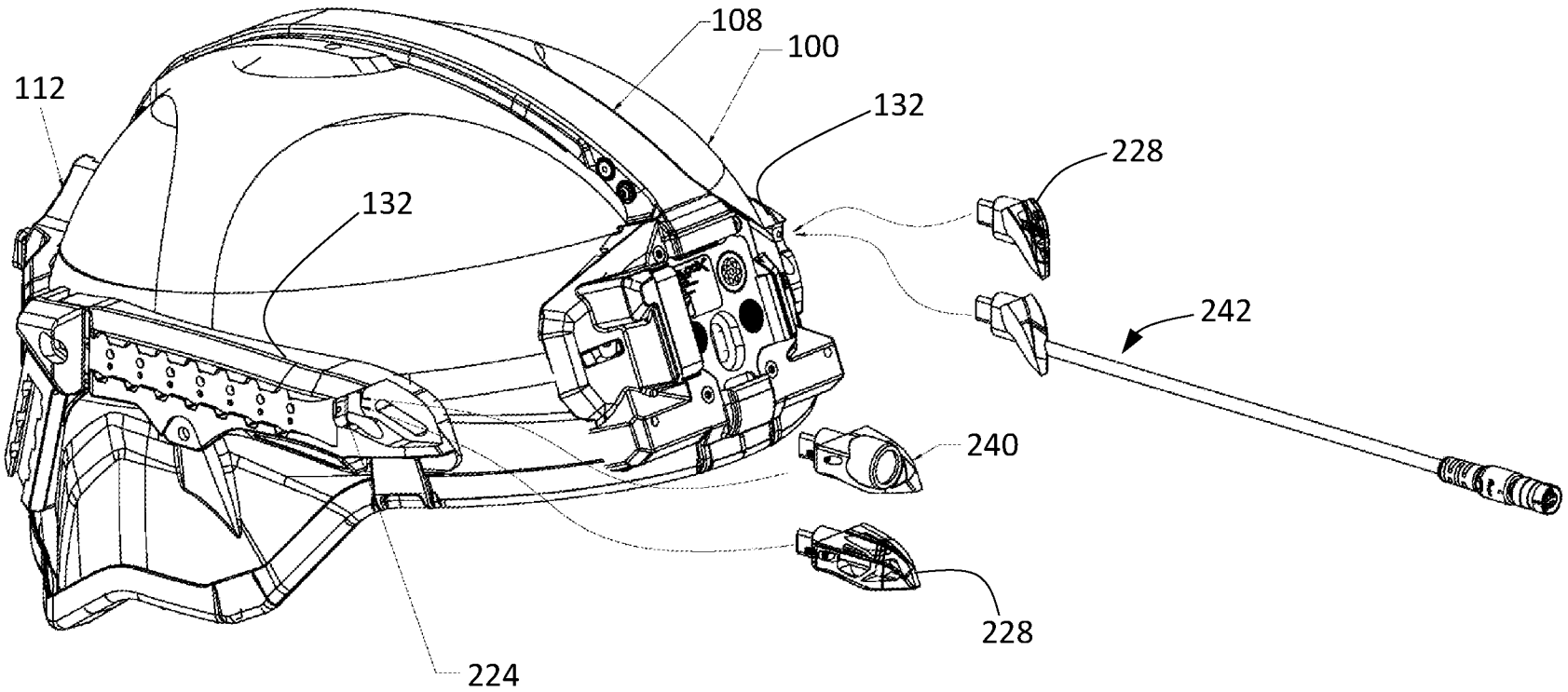
FIG. 20 is an isometric view of a helmet system having modular connector sockets and modular interchangeable plugs.
Figure 21:
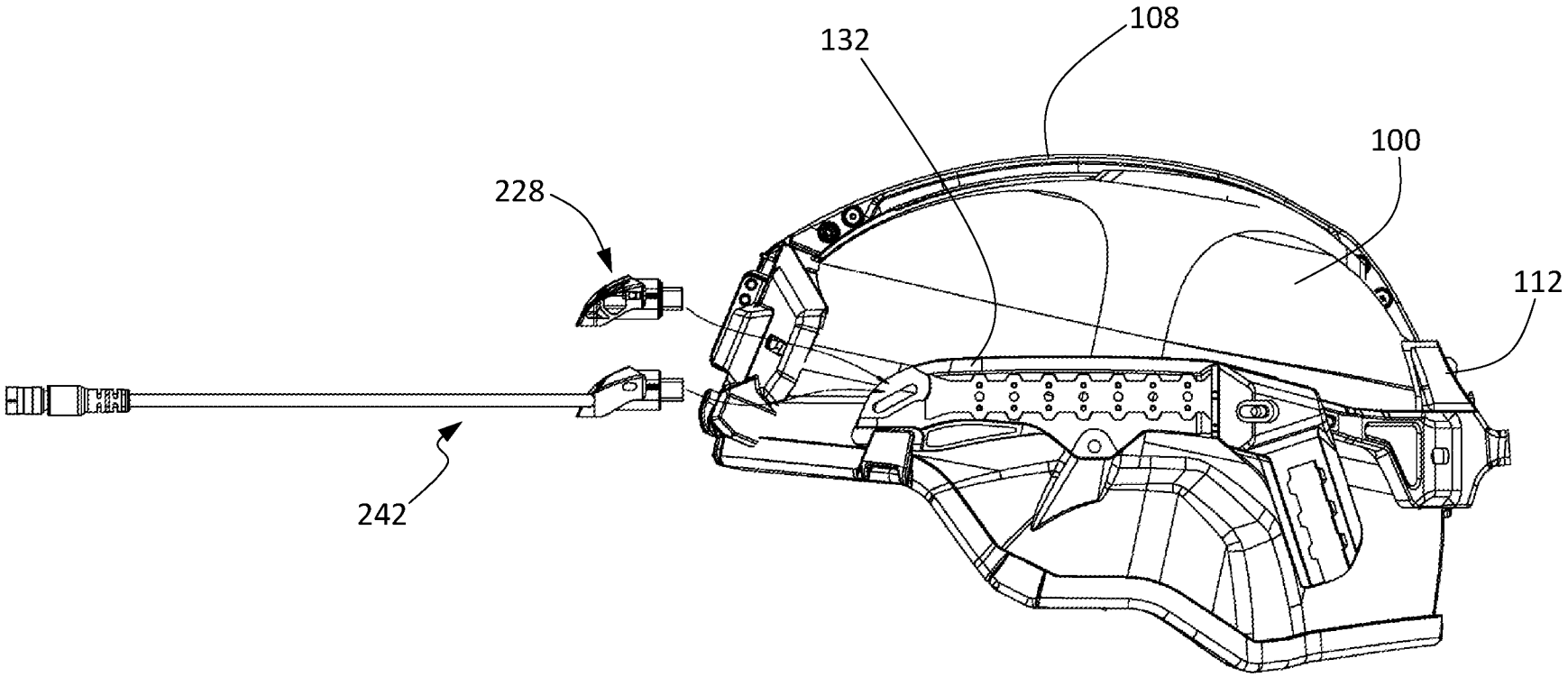
FIG. 21 is a left side view of the helmet system appearing in FIG. 20.
Figure 22:
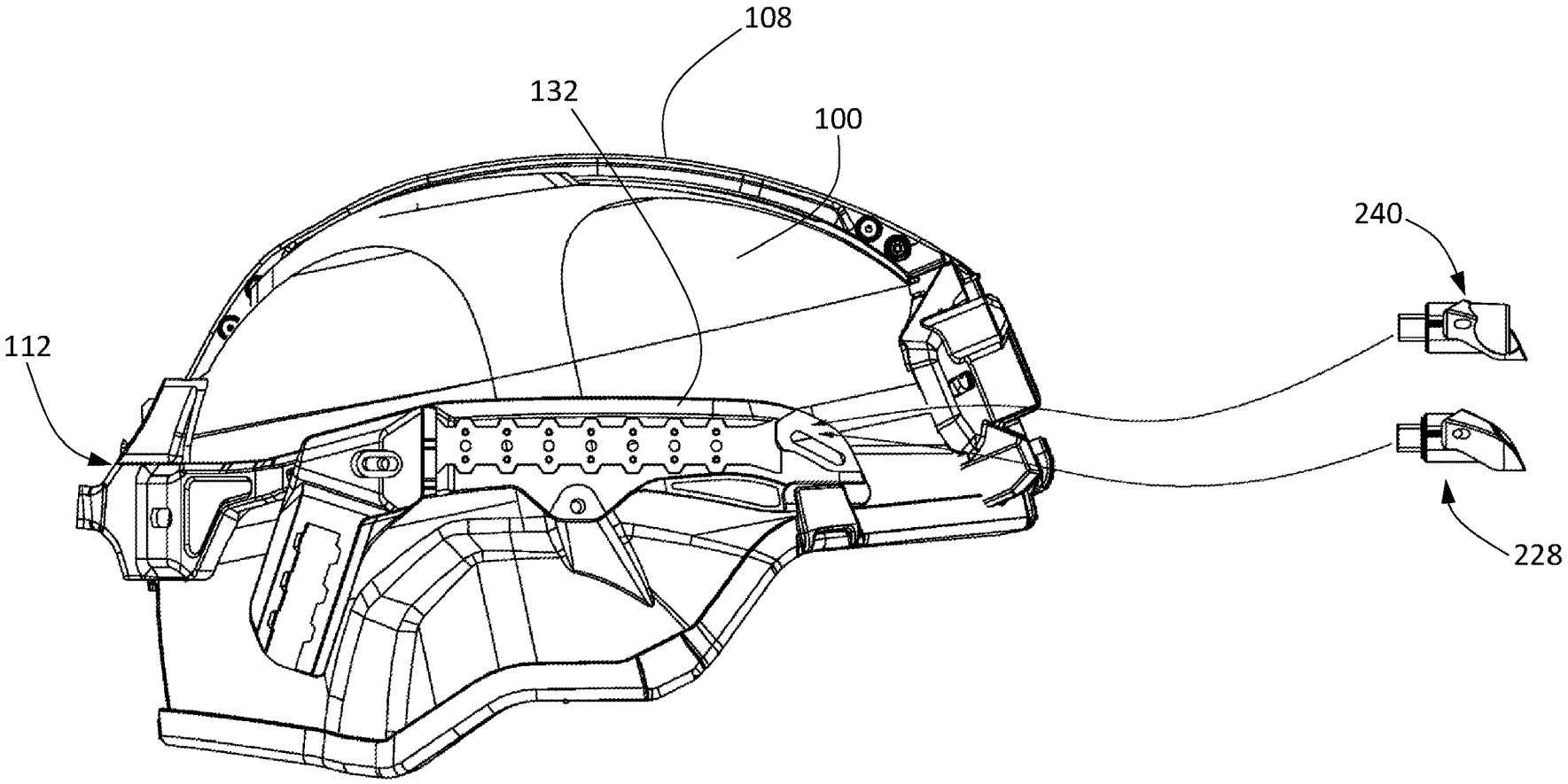
FIG. 22 is a right side view of the helmet system appearing in FIG. 20.
Figure 23:
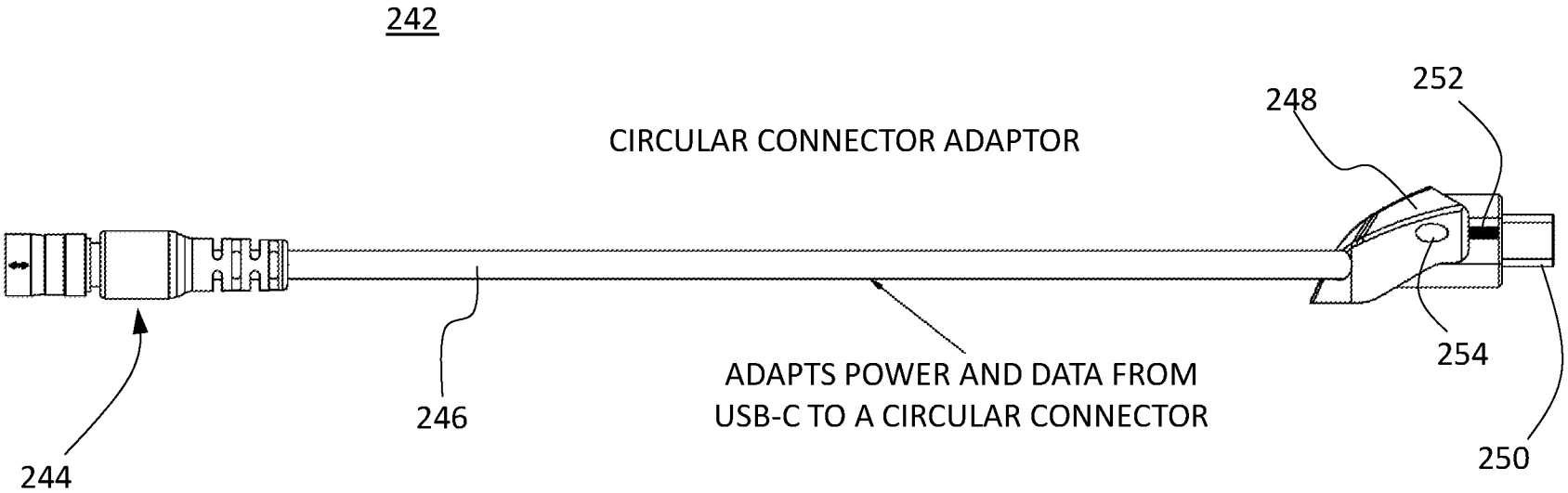
FIG. 23 is an enlarged view of the circular connector adapter appearing in FIG. 20.
Figure 25:
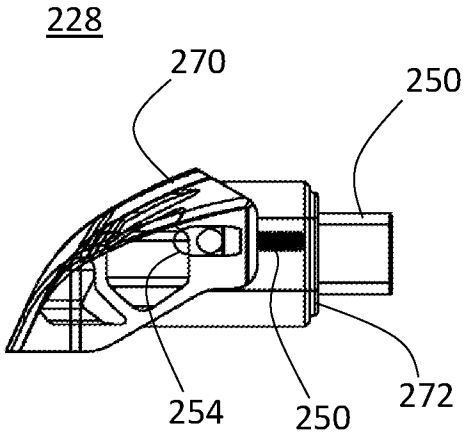
FIGS. 25 and 28 are an enlarged views of the light emitting adapter appearing in FIG. 20.
Figure 24:
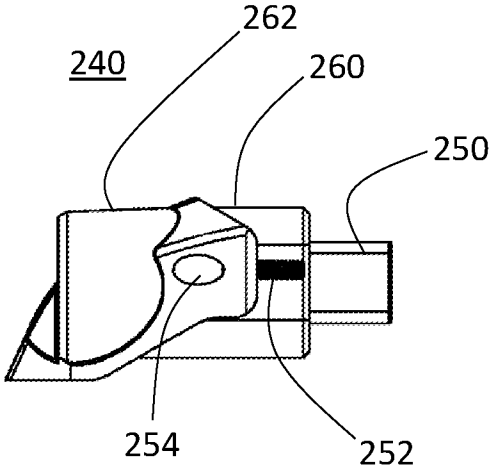
FIG. 24 is an enlarged view of the camera adapter appearing in FIG. 20.
Figure 26:
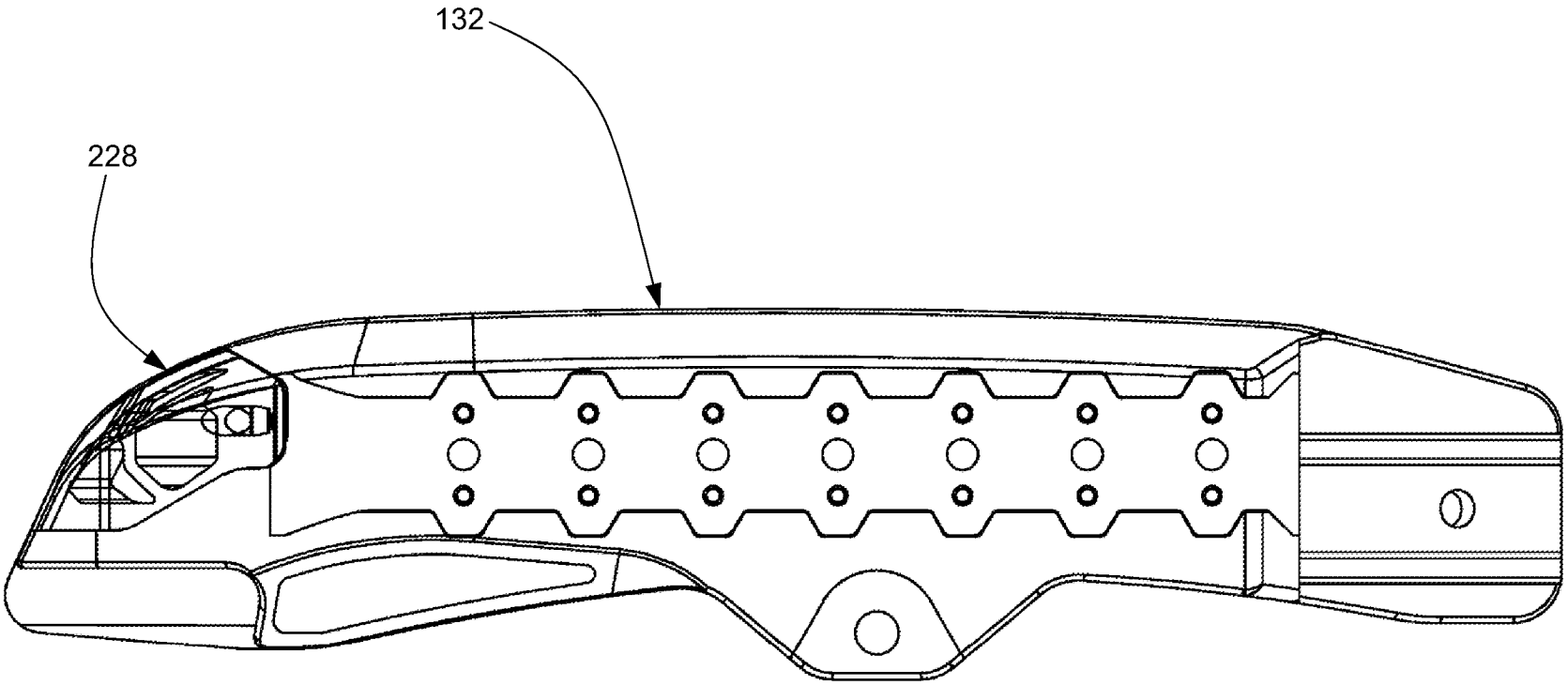
FIG. 26 is a side view of the left shroud having the light emitting adapter attached thereto.
Figure 27:
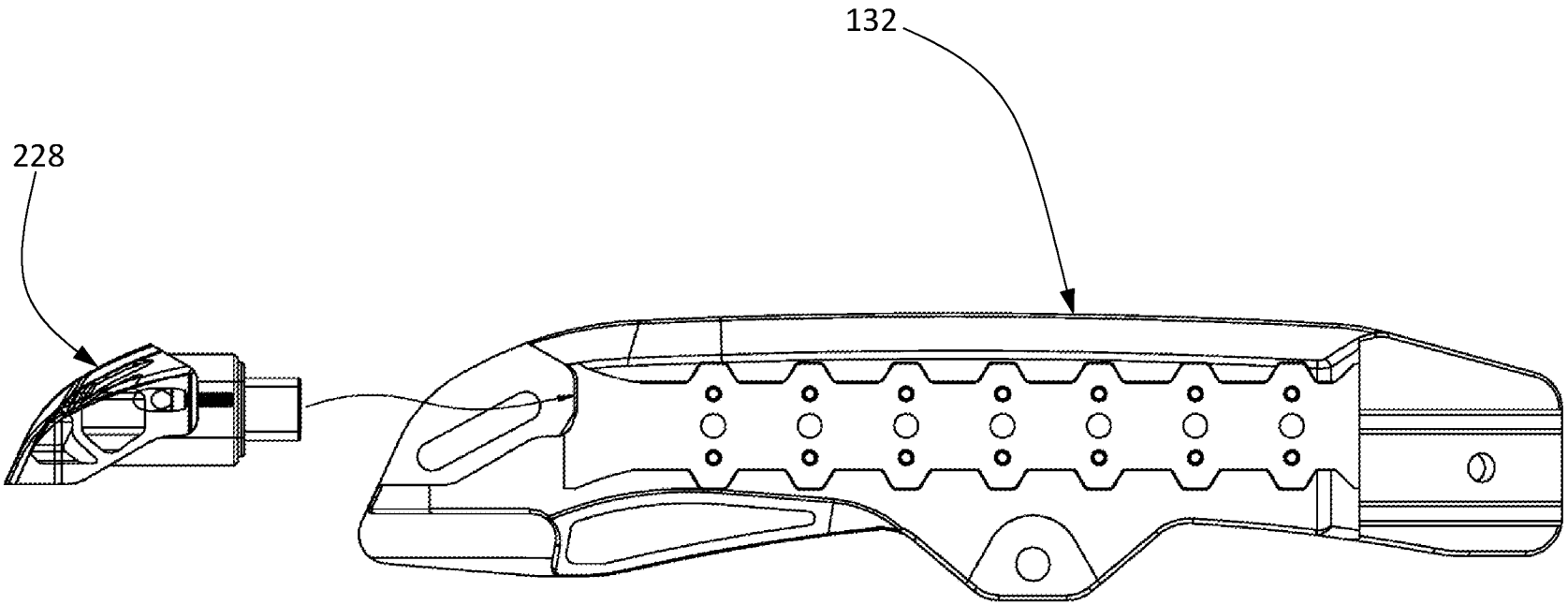
FIG. 27 is an exploded left side view of the left shroud and light emitting adapter appearing in FIG. 26.
Figure 29:
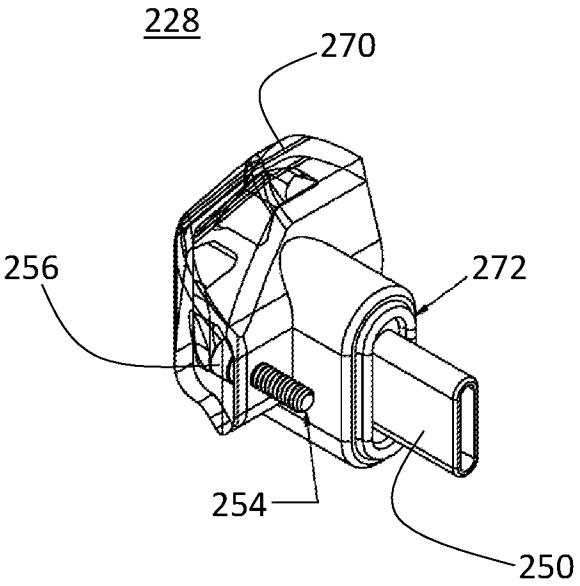
FIG. 29 is an enlarged, isometric view of the light emitting adapter, taken generally from the rear.
Figure 28:
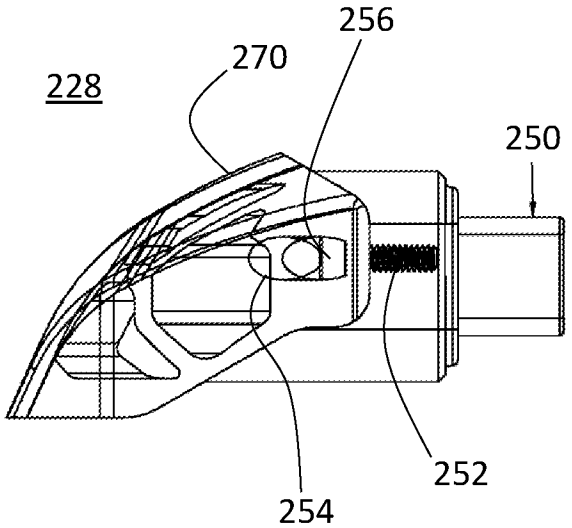
Figure 30:
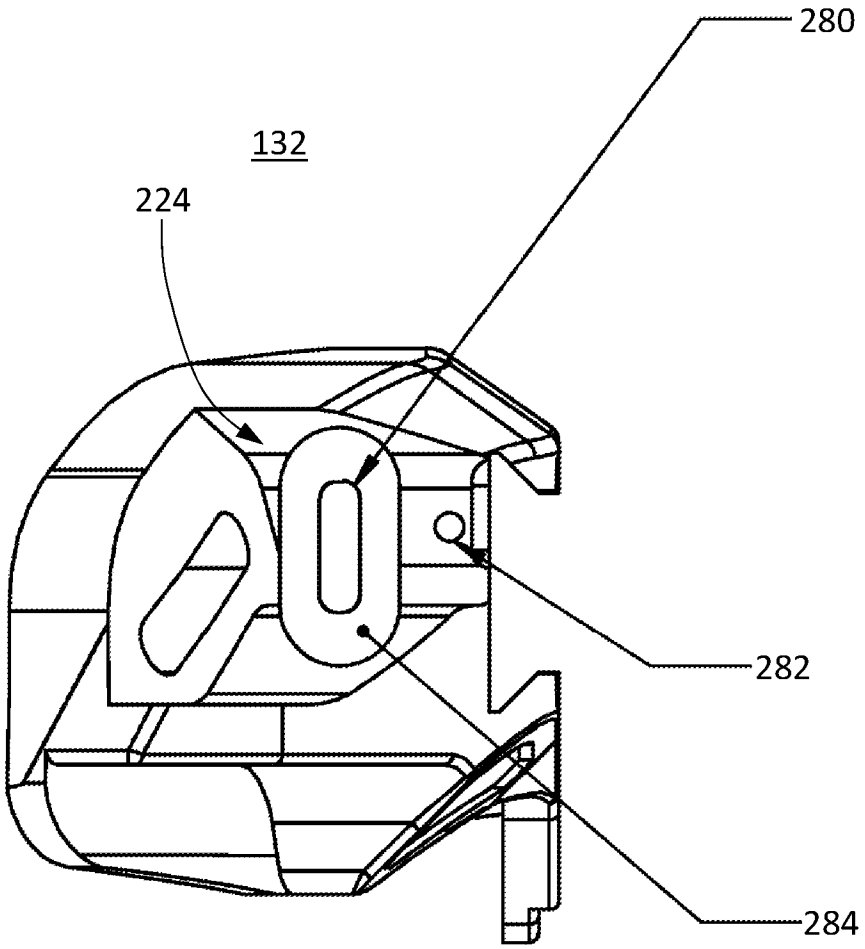
FIG. 30 is an enlarged front view of the right shroud.

The system provides right and left headlights 228. In embodiments, the flashlight modules 228 include visible light emitters, IR emitters, multi-color emitters, off-band emitters, or combinations thereof. In embodiments, the flashlight modules 228 are hot swappable to allow users to upgrade or change light configurations. For example, a user may choose to have two visible LED modules 228, 2 IR LED modules 228, or one of each. In certain embodiments, the LED modules 228 may have emitters that emit at different wavelengths, e.g., visible and IR, wherein the mode is selected by the user, e.g., via the network controller 208 or other interface such as an app on a wired or wirelessly attached mobile device. The headlamps 228 are powered and controlled through the car brackets of the shroud 132 to a back-connected central network controller 208 as shown in FIGS. 18 and 19 below.

Figure 12:
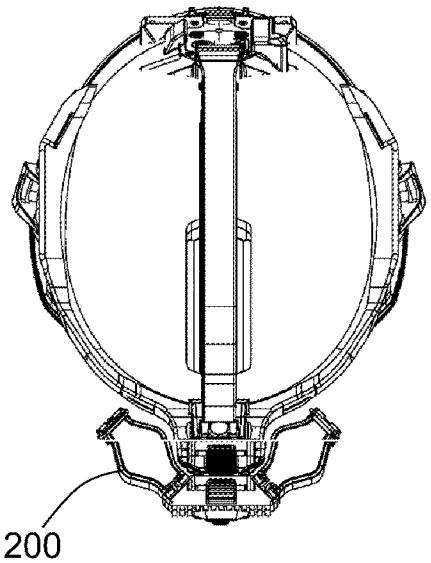
FIG. 12 is a top plan view of the helmet system appearing in FIG. 1 with a hot shoe adapter and Wilcox battery pack attached to the rear mount.
Figure 13:
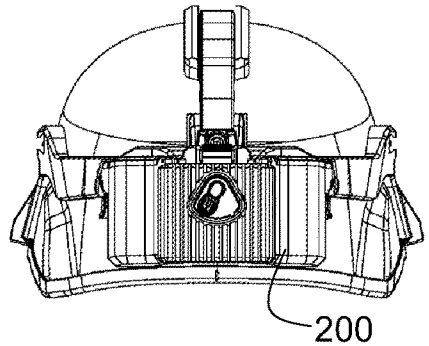
FIG. 13 is a rear view of the helmet system and rear attachments appearing in FIG. 12.

Referring now to FIGS. 12 and 13, and with continued reference to FIGS. 1-11, there appears a first configuration of the helmet system herein wherein the hot shoe adapter 156 is attached to the battery interface shoe 114 and a Wilcox battery pack 200 is, in turn, attached to the hot shoe adapter 156. The Wilcox battery pack may be of the type described in commonly-owned U.S. Pat. No. 10,557,687, which is incorporated herein by reference in its entirety.

Figure 14:
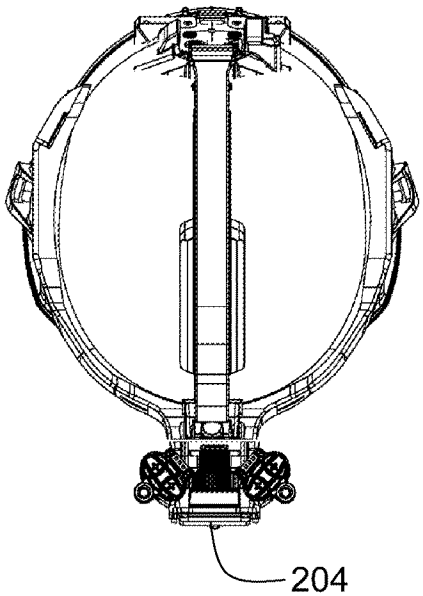
FIG. 14 is a top plan view of the helmet system appearing in FIG. 1 with a hot shoe adapter and Harris L3 or Elbit battery pack attached to the rear mount.
Figure 15:
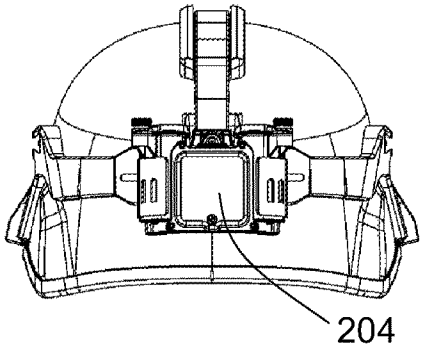

Referring now to FIGS. 14 and 15, and with continued reference to FIGS. 1-13, there appears a second configuration of the helmet system herein wherein the hot shoe adapter 156 is attached to the battery interface shoe 114 and an Elbit battery pack or Harris L3 battery pack 204 is, in turn, attached to the hot shoe adapter 156.

Figure 16:
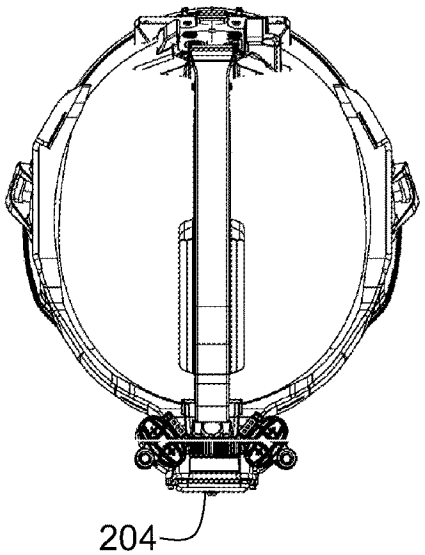
FIG. 16 is a top plan view of the helmet system appearing in FIG. 1 with the hot shoe adapter removed and Harris L3 or Elbit battery pack attached directly to the rear mount.
Figure 17:
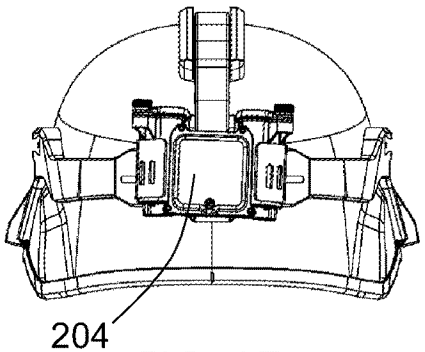
FIG. 17 is a rear view of the helmet system and rear attachments appearing in FIG. 16.

Referring now to FIGS. 16 and 17, and with continued reference to FIGS. 1-15, there appears a third configuration of the helmet system herein wherein the hot shoe adapter 156 is omitted and an Elbit battery pack (e.g., ENVG-B battery box) or Harris L3 battery pack 204 is attached directly to the battery interface shoe 114.

Referring now to FIG. 18 with continued reference to FIGS. 1-17, there is shown the mounting system appearing in FIGS. 8 and 9, wherein the Wilcox battery pack 200 is attached to the mounting shoe 158 of the hot shoe adapter 156. Referring now to FIG. 19 with continued reference to FIGS. 1-18, the system appearing in FIG. 18 appears with the Wilcox battery pack 200 removed. The adapter 156, in turn, is coupled to a central network controller module 208 via connector cable 212. The cable 212 is preferably a USB-C cable having locking connectors ends 216. The connector ends 216 engage complementary connector sockets 220*a*, 220*b* on the network controller module 208 and the hot shoe adapter 156, respectively. In embodiments, the network controller module 208, locking connector ends 216, and connector sockets 220*a*, 220*b* are as described in commonly-owned U.S. provisional application Ser. No. 63/423,324 filed on Nov. 7, 2022, which is incorporated herein by reference in its entirety. In preferred embodiments, the connector socket 220*a* points downward to facilitate connection to the network controller module 208. The network controller module 208 may be attached to a weapon carrier by the user or worn on a garment or other equipment worn by the user.

Referring now to FIGS. 20-30, there is illustrated a front modular connector system for the left and right shrouds 132. Each shroud 132 includes a socket or receptacle 224 for receiving a plurality of modular and interchangeable attachments or accessories, wherein the plurality of modular and interchangeable attachments or accessories have a plurality of utilities, designs, or both. In certain embodiments, the interchangeable modules include the LED head lamps 228, a camera 240, and a USB-C adapter cable 242.

The adapter cable 242 includes a connector end 244 coupled to a cable 246. In the illustrated embodiment, the connector end 244 is a Fischer type circular connector plug, although it will be recognized that other connector types are contemplated, such as legacy connectors from Omnetics Connector Corporation, Crane Aerospace & Electronics, and Wilcox Industries Corp. The cable 246 terminates in a shroud connector end housing 248 having a USB type C plug 250. The plug 250 releasably engages a socket 280 in the receptacle 224 which provides an electrical coupling for the communication of data, power, and/or control, signals. A captured screw fastener 252 is captured within a bore 254 and detachably engages a tapped retention hole 282 in the shroud 132. In embodiments, the bore 254 includes a counterbore to provide tool access to a head 256 of the threaded fastener 252, thereby allowing the screw head 256 of the screw fastener 252 to be recessed with respect to the surface of the housing 248. A sealing ring or gasket may be provided around the plug 250 to inhibit or prevent ingress of moisture or other external contamination by providing a scaling interference or contact with a sealing surface 284 in the recess 224.

The camera 240 includes a housing or body 260, a lens assembly 262, and a USB type C plug 250. The plug 250 releasably engages the socket 280 in the receptacle 224 which provides an electrical coupling for the communication of data, power, and/or control, signals. The outer housing 260 includes a bore 254 having a captured screw fastener 252 which detachably engages a tapped retention hole 282 in the shroud 132. In embodiments, the bore 254 includes a counterbore to provide tool access to allow the screw head 256 of the screw fastener 252 to be recessed with respect to the surface of the housing 260. A sealing ring or gasket may be provided around the plug 250 to prevent ingress of moisture or other external contamination by providing a sealing interference or contact with a sealing surface 284 in the recess 224.

In embodiments, the camera 240 is operatively coupled to a recording module disposed on the helmet system. In embodiments, the camera 240 is operatively coupled to a wireless communication device for transmitting video information over a wireless network. In embodiments, the camera may be a visible light camera, low lux camera, thermal camera, infrared (IR) camera, and others. In embodiments, a plurality of interchangeable camera types may be provided and selected by the user depending on the recording conditions. In embodiments, the camera 240 is controlled by the network controller module 208.

The LED headlamp 228 includes a housing 270 and a USB type C plug 250. The plug 250 releasably engages the socket 280 in the receptacle 224 which provides an electrical coupling for the communication of data, power, and/or control, signals. The housing 270 includes a bore 254 having a captured screw fastener 252 which detachably engages a tapped retention hole 282 in the shroud 132. In embodiments, the bore 254 includes a counterbore to provide tool access to allow the screw head 256 of the screw fastener 252 to be recessed with respect to the surface of the housing 270. A sealing ring or gasket 272 may be provided around the plug 250 to prevent ingress of moisture or other external contamination by providing a sealing interference or contact with a sealing surface 284 in the recess 224.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A modular side shroud assembly for a helmet mounting system associated with a helmet having a shell, the side shroud assembly comprising:

a housing enclosing shroud circuitry, the housing configured to detachably couple to a lateral side portion of the helmet shell, the lateral side portion of the helmet shell being positioned adjacent an ear region of a user when the helmet is worn by the user;

a proximal end of the housing configured to couple to a rear battery interface of the helmet mounting system; and a forward end of the housing defining a recessed receptacle formed in the housing, the recessed receptacle being configured to removably couple a plurality of modular and interchangeable accessory devices, wherein the recessed receptacle includes an electrical connector disposed within the recessed receptacle and electrically coupled to the shroud circuitry enclosed within the housing, and wherein the recessed receptacle is configured to receive at least a portion of a body of each of the plurality of modular and interchangeable accessory devices such that the portion of the body is disposed within the recessed receptacle.

2. The modular side shroud assembly of claim 1, in combination with the plurality of modular and interchangeable accessory devices, wherein the plurality of modular and interchangeable accessory devices are modular and interchangeable for a plurality of utilities, a plurality of designs, or both.

3. The modular side shroud assembly of claim 2, wherein the plurality of accessory devices are selected from the group consisting of headlamps, cameras, cable adapters, visible light headlamps, infrared headlamps, multi-color headlamps, off-band headlamps, and any combination thereof.

4. The modular side shroud assembly of claim 1, wherein the electrical connector is a USB type-C socket.

5. The modular side shroud assembly of claim 1, wherein the recessed receptacle includes a threaded retention hole configured to receive a threaded fastener on one of the accessory devices when the one of the accessory devices is coupled to the recessed receptacle.

6. The modular side shroud assembly of claim 5, wherein the threaded fastener is captured on a housing of the accessory device.

7. The modular side shroud assembly of claim 1, wherein the recessed receptacle includes a sealing surface disposed thereon and configured to inhibit intrusion of moisture.

8. The modular side shroud assembly of claim 1, wherein said shroud circuitry comprises a powered interface circuit board and a flex circuit comprising circuit components on a flexible substrate extending between the powered interface circuit board and at least one side shroud electrical contact.

9. The modular side shroud assembly of claim 1, further comprising a powered rail and data interface portion comprising at least one attachment position configured for removable attachment and powering of a rail mountable accessory device.

10. A helmet mounting system comprising first and second modular side shroud assemblies in accordance with claim 1.

11. The helmet mounting system of claim 10, further comprising any one or more of an identification friend or foe (IFF) module, a controller module in electrical communication with the housing circuitry, and a video camera recording module in electrical communication with the housing circuitry.

12. The helmet mounting apparatus of claim 10, wherein the plurality of modular and interchangeable accessory devices includes a camera, the helmet mounting apparatus further comprising a wireless communication interface configured to transmit video information over a wireless network.

13. The helmet mounting apparatus of claim 10, wherein the plurality of modular and interchangeable accessory devices includes a camera selected from the group consisting of a visible light camera, a low lux camera, a thermal camera, and an infrared camera.

14. The helmet mounting system of claim 10, further comprising a rear bridge link assembly attachable to the helmet intermediate the first and second modular side shroud assemblies, the rear bridge link assembly configured to electrically couple the shroud circuitry of the first modular side shroud assembly and the second modular side shroud assembly.

15. The helmet mounting system of claim 14, further comprising a front shroud assembly configured to be attached to a front of the helmet and a strap extending between the front shroud assembly and the rear bridge link assembly, the strap housing a plurality of electrical conductors for electrically coupling the front shroud assembly to the rear bridge link assembly.

16. The helmet mounting system of claim 14, further comprising:

said proximal end of each of said first and second side shroud assemblies comprises a lip; and said rear bridge link assembly comprises a side flange that engages with each of said lips to form a mechanical coupling between each of the first and second side shroud assemblies and the rear bridge link assembly.

17. The helmet mounting system of claim 14, wherein the rear bridge link assembly includes at least one battery interface for detachable coupling to a battery pack.

18. The helmet mounting system of claim 14, wherein the rear bridge link assembly is operable to transmit one or both of data and control signals between the first and second modular side shroud assemblies.

* * * * *